US005188528A

United States Patent [19]

Rast

[11] Patent Number: 5,188,528

[45] Date of Patent: Feb. 23, 1993

[54] METHOD AND APPARATUS FOR LINING THE INTERIOR SURFACE OF A HIGH TEMPERATURE CHAMBER WITH HEAT INSULATION MATERIAL

[76] Inventor: James P. Rast, 9510 Herring Hill Rd., Millington, Tenn. 38053

[21] Appl. No.: 788,126

[22] Filed: Nov. 5, 1991

Related U.S. Application Data

[62] Division of Ser. No. 496,004, Mar. 20, 1990, Pat. No. 5,067,420.

[51] Int. Cl.[5] ..... F27D 1/00

[52] U.S. Cl. ..... 432/248; 110/336; 110/332

[58] Field of Search ..... 432/248, 251, 252; 110/331-336, 340, 339

[56] References Cited

U.S. PATENT DOCUMENTS

| | | | |
|---|---|---|---|
| 3,854,262 | 12/1974 | Brady | 110/336 |
| 4,287,839 | 9/1981 | Severin et al. | 110/336 |
| 4,449,345 | 5/1984 | Hounsel et al. | 110/336 |
| 4,494,295 | 1/1985 | Herring | 110/336 |
| 4,680,010 | 7/1987 | Ginzburg et al. | 432/148 |
| 4,803,822 | 2/1989 | Deren | 110/336 |
| 4,850,171 | 7/1989 | Deren | 110/336 |
| 4,955,809 | 9/1990 | Viertola | 110/336 |

*Primary Examiner*—Henry C. Yuen

*Attorney, Agent, or Firm*—Watson, Cole, Grindle & Watson

[57] ABSTRACT

A method for forming an insulation lining of abutting modules in a high temperature chamber. The method comprises forming a modular fiber blanket surrounded by a retaining means to maintain the module in a pleated configuration. A plurality of hanger means cooperate with a support portion and an elongated prong means. The prong means is inserted into the hanger means and through the pleated body to form a plurality of modules. A surface is provided on the support part for engaging the prongs of an adjacent module to stabilize the module and ensure that the modules are accurately located and maintained in operative position on the interior surface of the high temperature chamber.

9 Claims, 6 Drawing Sheets

FIG. 11
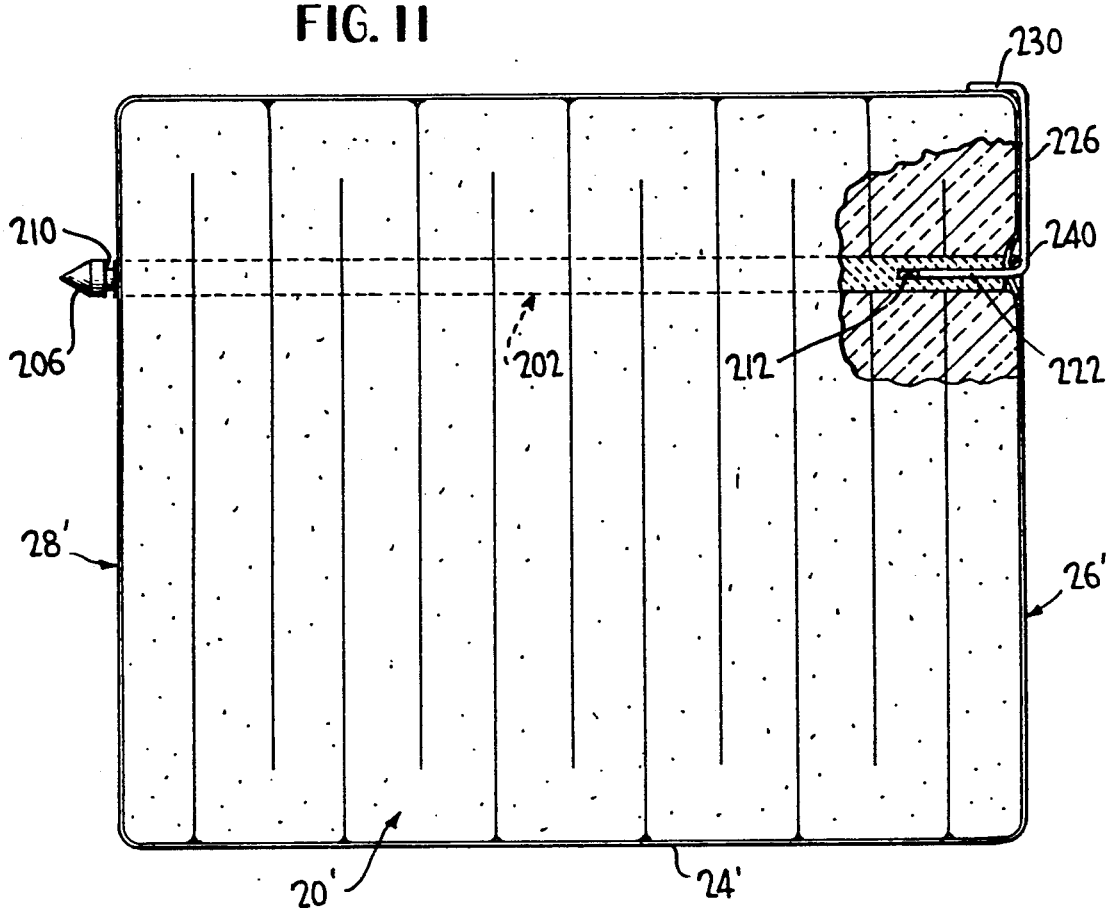
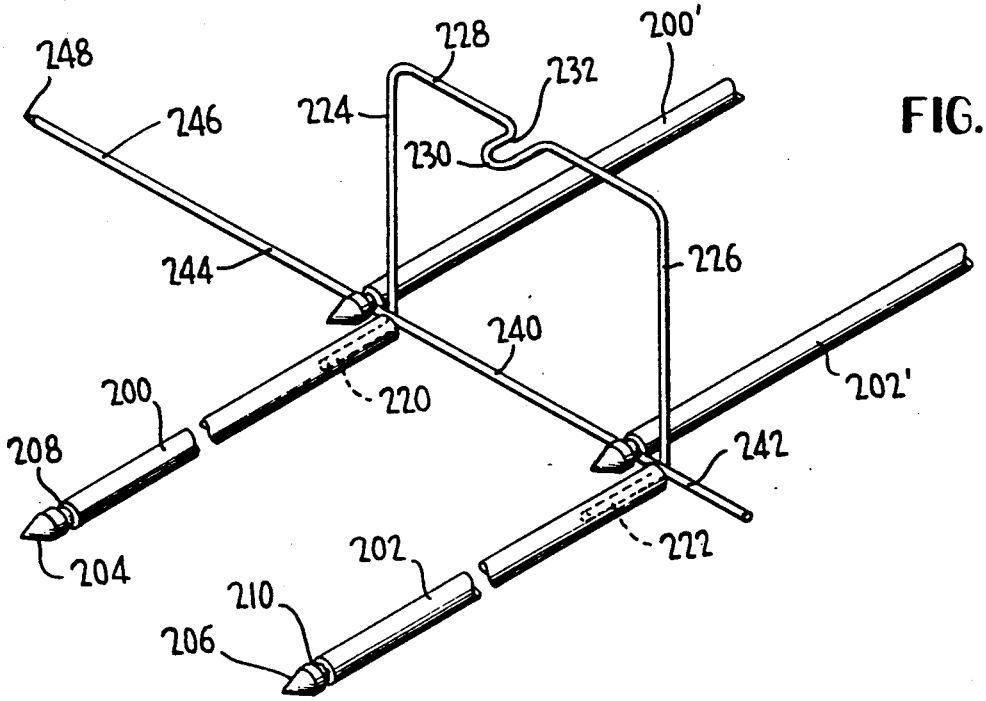
FIG. 12

METHOD AND APPARATUS FOR LINING THE INTERIOR SURFACE OF A HIGH TEMPERATURE CHAMBER WITH HEAT INSULATION MATERIAL

This application is a divisional application of application Ser. No. 07/496,004, filed Mar. 20, 1990, now U.S. Pat. No. 5,067,420.

BACKGROUND OF THE INVENTION

The present invention relates to a method and apparatus for lining the interior surface of a high temperature chamber such as a furnace or the like with heat insulation material.

This invention provides an improvement over the invention disclosed in my U.S. Pat. No. 4,336,086. As pointed out in my patent, several different approaches have been followed in the prior art in lining such interior surfaces. Roll-type insulation has been applied to an interior surface in flat multiple layers and attached to the interior surface by metal bolts or studs extending through the insulation. In another prior art arrangement, strips or layers of insulation have been attached to metal plates to form blocks which were bolted or welded to an interior surface. In still another known arrangement, a single layer of insulation has been attached in a sinuous manner to a metal backing to form blocks which were attached to an interior surface by a bolt embedded in or covered by the insulation. As discussed in my patent, all of these prior art arrangements have disadvantages which make them unsatisfactory.

Another concept employed in lining such interior surfaces is to attach a plurality of hanger means to an interior surface and then cause the hanger means to penetrate into the insulation material to retain the insulation in place. In my patent, a plurality of hook means are fixedly attached to an interior surface, and a blanket of insulation material is folded upon itself to create folds which are pressed onto the hook means to support the insulation in place.

This last mentioned method of lining interior surfaces is time consuming and requires a skilled worker to ensure that an effective lining is obtained. Furthermore, it is almost impossible to obtain uniform compaction of the fibers of the insulation material which is a highly desirable objective.

SUMMARY OF THE INVENTION

The present invention employs a blanket of heat insulation material folded upon itself to form a body means of pleated configuration which is surrounded by a retaining means to retain the body means in pleated configuration. A cooperating hanger means is provided with a support portion adapted to be connected to an inner surface to be insulated. The hanger means also includes prong means extending from the support portion thereof.

The prong means of a hanger means is inserted from one side of a pleated body means of insulation material through the body means so that the outer end portion of the prong means extends outwardly beyond the opposite side of the body means to thereby form an insulation module. A plurality of such modules are similarly formed.

The modules are then connected to an interior surface to be insulated by mounting a first module in place on the surface, and then sequentially mounting additional modules in place in a unique manner. Each subsequent module is moved into operative position relative to a previously mounted module such that the outer end portion of the prong means of the previously mounted module is engaged with an engaging surface on the support portion of the subsequent module, and the outermost end of the outer end portion of the prong means on the previously mounted module is embedded within the body means of the subsequent module. Adjacent hanger means are thus accurately positioned and held in place relative to one another.

Adjacent rows of mounted modules are spaced laterally from one another. An expansion joint is provided between facing lateral sides of adjacent rows of modules to compensate for shrinkage of the insulation material of the body means of the modules. In the roof surface of the high temperature chamber, certain hanger means are provided with a laterally extending support member to support an associated expansion joint.

The present invention enables a heat insulation lining to be assembled in operative position in a minimum amount of time without the necessity of providing skilled workers. Substantially uniform compaction of the fibers of the insulation material is obtained, and the hanger means are interengaged with one another to maintain them in proper relationship.

BRIEF DESCRIPTION OF THE DRAWINGS

FIG. 11 is a view, partly in section, through an insulation module employing a fifth form of hanger means according to the invention; and FIG. 12 is a top perspective view showing the manner in which two adjacent hanger means as shown in FIG. 11 cooperate with one another.

DESCRIPTION OF THE PREFERRED EMBODIMENTS

Figure 1:
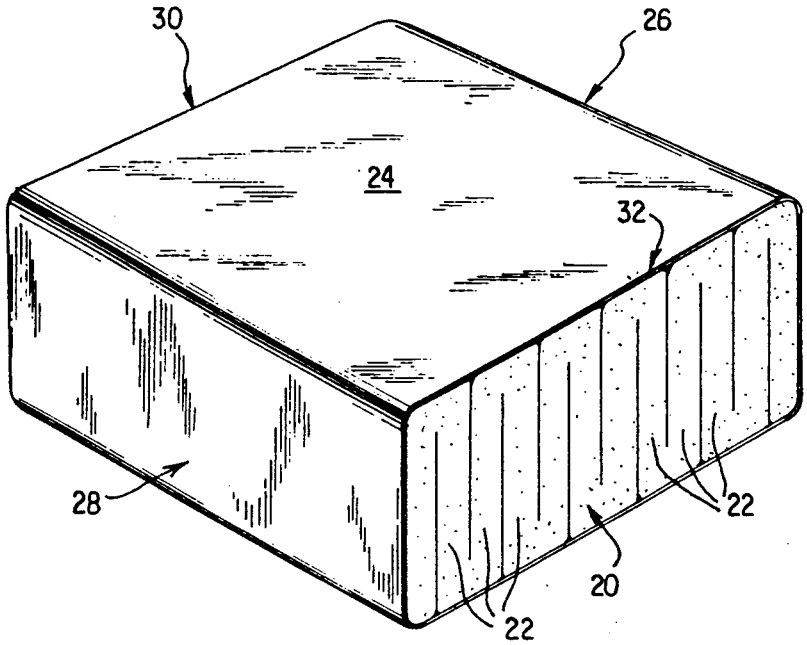
FIG. 1 is a top perspective view of a pleated body means of insulation material surrounded by a retaining means.

Referring not the drawings wherein like reference characters designate corresponding parts throughout the several views, as seen in FIG. 1, there is first provided a blanket of heat insulation material indicated generally by reference character 20. The blanket is of well-known construction, and may be formed of ceramic fibers, and typically may be of about one inch in thickness. The blanket is folded upon itself to form a body means having pleats 22 formed therein. The body means provides a durable lining capable of withstanding extremes of temperature, corrosion elements, gas velocities and physical abuse.

The folded blanket is surrounded by a retaining means 24 which may comprise a sheet of shrink-wrap plastic material which is combustible. The retaining means compresses the fibers of the blanket and maintains the body means in its pleated configuration until the insulation is mounted in operative position within a furnace or the like; and the retaining means then burns away when the furnace is fired up. The body means has opposite sides 26 and 28 and lateral sides 30 and 32. The sides of body means may each be about one foot in length, and the thickness of the body means may be in the range of three inches to one foot.

Figure 6:
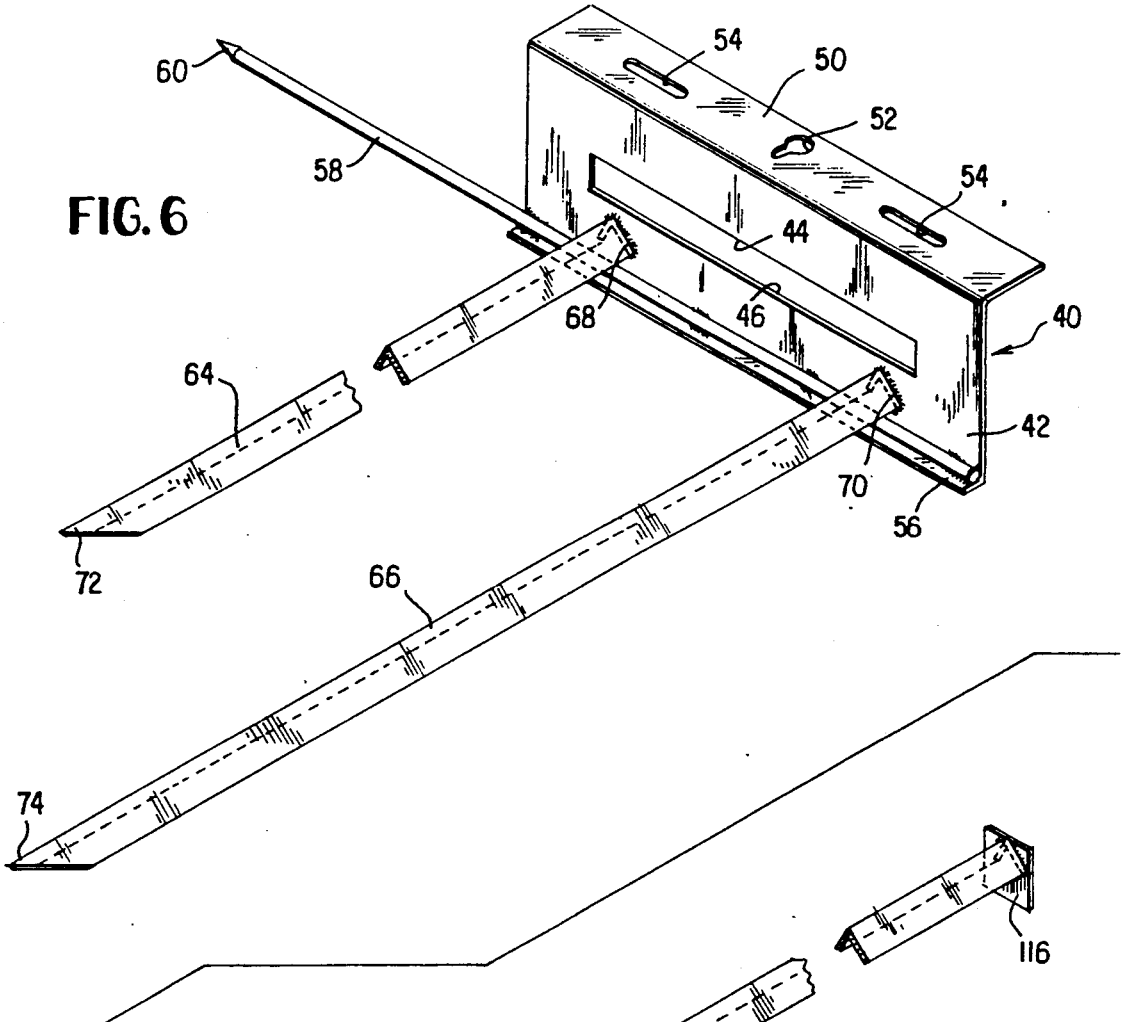
FIG. 6 is a top perspective view of a first form of hanger means.

Referring now to FIG. 6, a first form of hanger means 40 includes a support portion formed of stainless steel plate including a plate portion 42 having an elongated opening means 44 in the form of a rectangular hole formed therethrough. An engaging surface 46 defines one side of opening means 44 for a purpose hereinafter described. An integral flange 50 extends at a substantially right angle from the upper edge of plate portion 42 to one side thereof and has a keyhole-shaped slot 52 formed therethrough. A pair of elongated holes 54 are formed through flange 50 at either side of slot 52.

A further integral flange 56 extends at a substantially right angle from the lower edge of plate portion 42 to the other side thereof. An elongated stainless steel support member 58 is supported on flange 56 and is suitably secured thereto as by welding. The outer end of support member 58 terminates in a sharp point 60. The laterally extending support member of this form of hanger means as well as the laterally extending support member of the other forms of hanger means is employed with certain insulation modules mounted on the roof of a furnace or the like. The laterally extending support members can be eliminated when the hanger means is employed on other interior surfaces such as a side wall.

Prong means is supported by the support portion and includes a pair of spaced generally parallel prongs 64 and 66 formed of stainless steel and being of similar construction. Each of the prongs is of generally V-shaped cross-section to provide a certain degree of rigidity thereto. The inner ends 68 and 70 of the prongs are secured as by welding to plate portion 42 and the prongs extend substantially perpendicular to the plate portion. The outer ends 72 and 74 are pointed to facilitate penetration of the prong through an associated body means.

Figure 2:
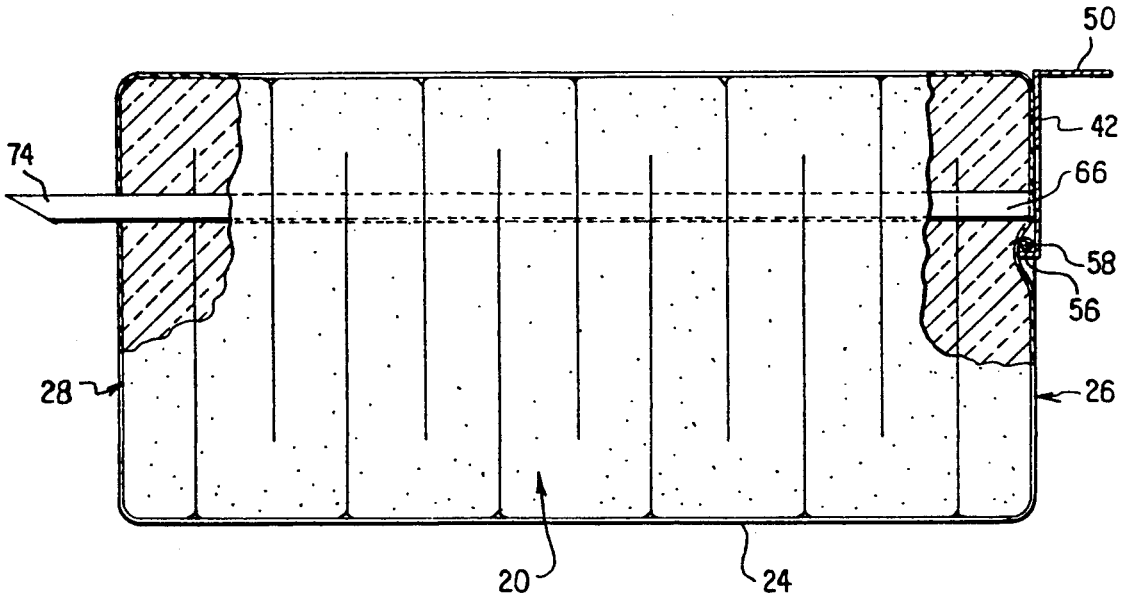
FIG. 2 is a view, partly in section, through an insulation module according to the invention.

After the pleated body means surrounded by the retaining means and the hanger means are provided, the prong means of the hanger means is inserted through one side 26 of the body means as seen in FIG. 2 until the plate portion 42 is disposed adjacent to side 26. The outer end portions of the prongs extend outwardly beyond the opposite side 28 of the body means. In a typical example, the prongs may be thirteen inches in length when employed with a body means which has a dimension of twelve inches between surfaces 26 and 28 thereof. The assembly shown in FIG. 2 comprises an insulation module, and a plurality of similar modules are assembled prior to mounting the modules within a furnace or the like to form a lining therein.

Figure 4:
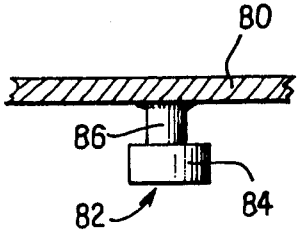
FIG. 4 is sectional view showing the means on the roof of a furnace for connecting the hanger means of the invention to the roof.

Referring now to FIG. 4, a steel casing 80 forms the roof of a furnace or the like and has a button head stud 82 welded to the undersurface thereof. Stud 82 includes a substantially cylindrical lower portion 84 and a reduced cylindrical portion 86 extending upwardly therefrom and welded to the roof. Portion 84 of the stud has a diameter slightly smaller than the diameter of the enlarged part of keyhole opening 52 in flange 50 of hanger means 40, while portion 82 of the stud has a diameter slightly smaller than the width of the reduced portion of keyhole opening 52. Accordingly, when it is desired to connect an insulation module to the roof, portion 84 of stud 82 is passed through the enlarged part of the keyhole opening whereupon the module may be moved laterally so that the reduced portion 86 of the stud enters the reduced portion of the keyhole opening and the module is supported from the stud.

The elongated holes 54 may also be utilized for welding the support portion of the hanger means to an interior surface of the furnace or the like for rigidly attaching the hanger means in place. It should be understood that a worker will initially attach all of the studs 82 in place on the interior surfaces to be lined in a regular grid-like arrangement so that the insulation modules will be properly positioned relative to one another. This is a simple task which can be readily performed.

Figure 3:
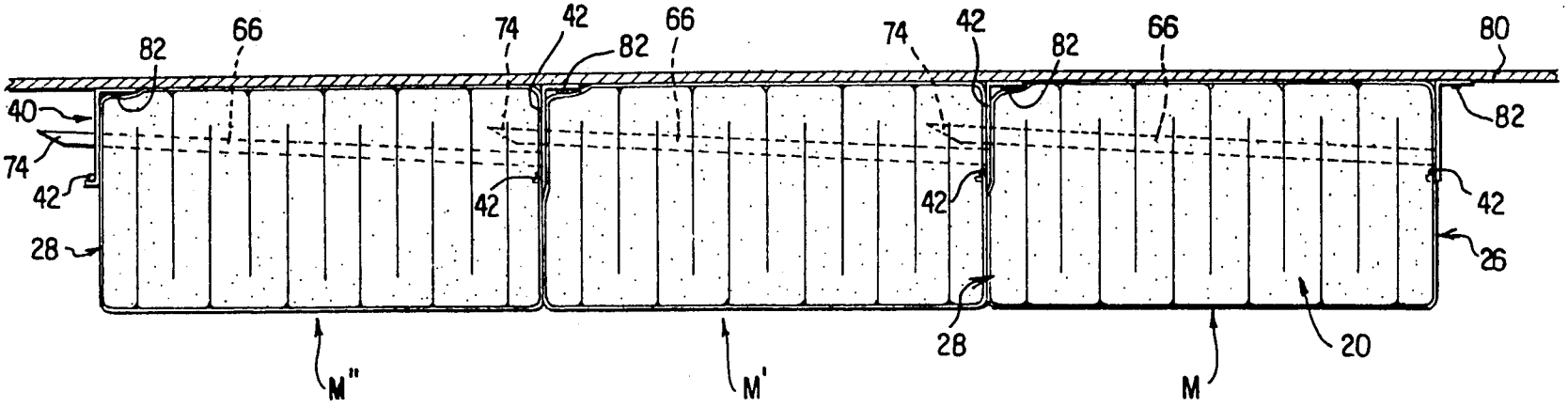
FIG. 3 is a cross-section showing a plurality of insulation modules mounted in operative position on a roof of a furnace.

Referring now to FIG. 3, the manner in which a plurality of insulation modules are mounted on an a roof surface is illustrated. It should be understood that FIG. 3 is a section through the roof of a furnace or the like, but a section through a side wall of a furnace would appear the same, and the same method steps as described in connection with a roof surface would also apply to lining of a side wall or any other surface. Three modules M, M' and M'' are shown, each of these modules being identical to the module shown in FIG. 2 and having the same reference numerals applied thereto. The support portion of the hanger means of module M is first interconnected with a stud 82 to support module M in the position shown with the body means thereof disposed adjacent the inner surface of the roof. It should be understood that the prong 74 will then be disposed substantially parallel with the roof, rather than in the position shown in dotted lines in this FIGURE.

The next step is to move module M' so that the plate portion 42 thereof moves against the side 28 of module M. Another stud 82 then enters the keyhole opening in the support portion of module M' and the body means of module M is compressed. The body means of module M' is disposed adjacent the inner surface of the roof. The outer ends 72 and 74 of the prongs 64 and 66 of module M are moved upwardly within the body means of module M to the dotted position shown and the outer ends of the prongs extend through slot 44 in the support portion of module M'. The slot 44 in the plate portion of the hanger means has a width large enough to slidably receive the prongs of a similar hanger means. The outer ends of the prongs of module M engage the engaging surface 46 of module M'. The pointed ends of the prongs of module M penetrate into the body means of module M'.

The interengagement of the prongs of one module with an engaging surface as well as the body means of an adjacent module stabilizes the modules and ensures that they are accurately located and maintained in the desired operative position.

Module M'' is then mounted in position relative to module M' in the same manner as module M' is mounted in position relative to module M. Accordingly, the body means of module M' is compressed, and the body means of module M" is disposed adjacent the inner surface of the roof. The outer ends of the prongs of module M' are moved upwardly into the dotted position shown, and the outer ends of the prongs of module M' extend through the slot in the support portion of module M" to engage the engaging surface thereon. The outer ends of the prongs of module M' penetrate into the body means of module M".

A hanger means 40 is shown as disposed adjacent the side 28 of the module M", this hanger means not having any prong means extending therefrom. This arrangement is employed when there is less space to the left of module M" as seen in FIG. 3 than the length of an insulation module. In this case, such space may be filled with a blanket of insulation folded upon itself to provide a lining similar to that provided in the insulation modules. Suitable means may also be provided for maintaining such folded blanket in position. The folded blanket is then wedged into position to fill such space, suitable means being provided to maintain the folded blanket in position. The hanger means associated with the right side of module M may be employed for starting the lining at a point near a side wall of the furnace or the like, and the space between this hanger means and the adjacent wall may likewise be filled with a blanket of insulation folded upon itself to provide a similar lining, with suitable means being provided to hold such folded blanket in position.

It will be understood that the sequence of steps as described in connection with FIG. 3 can be repeated over and over again to form a row of insulation modules having certain ones of the opposite sides thereof in abutting relationship to thereby line an interior surface.

Figure 5:
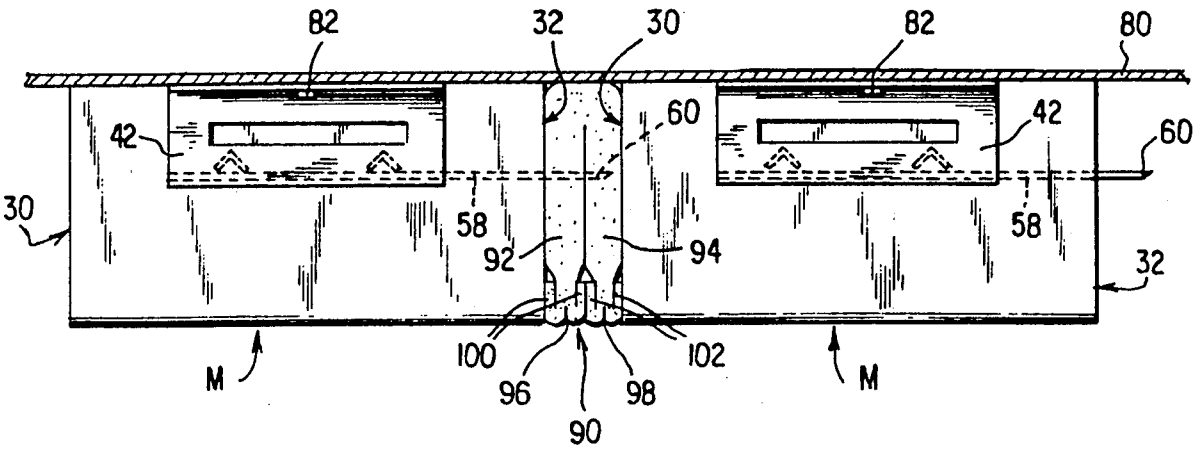
FIG. 5 is a cross-section through the roof of a furnace showing two insulation modules of adjacent rows of modules with an expansion joint therebetween.

Referring now to FIG. 5, two insulation modules M are shown which are identical to the module shown in FIG. 2. Each of these modules may comprise a first module M in a row of modules as shown in FIG. 3, the two modules in FIG. 5 being laterally spaced from one another such that the adjacent surfaces 32 and 30 thereof are spaced as shown. An expansion joint 90 is inserted between the lateral sides of the modules and is supported from the hanger means of the left-hand one of the modules by the laterally extending support member 58 the pointed end of which penetrates into the joint. The joint may have a thickness of about three inches, and the length thereof is the same as the length of the sides 30 and 32 of the module. It will be understood that in assembling these components, the left-hand module will first be mounted, and the joint then impaled on the support member 58, whereupon the right-hand module may then be mounted in the operative position shown.

The laterally extending support member 58 of the right-hand module may then be employed to support a further joint between the right-hand module and a further module spaced to the right of the modules pictured in FIG. 5.

The expansion joint 90 is formed by doubling a strip of blanket insulation upon itself to form pleats 92 and 94 the outer ends of which are split in half as indicated at 96 and 98 to provide pairs of ends 100 and 102 respectively which are tucked into the operative position shown. The expansion joint is compressed in the position shown and is adapted to expand to compensate for shrinkage of the adjacent ends of the pleats in the body means of the two adjacent modules which normally occurs during use.

It is noted that support members 58 are used to support the expansion joints in the roof of the furnace to ensure that the joints do not fall out of place under the influence of gravity. It is not necessary to so support the joints in the side walls of the furnace and, as noted earlier, the support members may be eliminated in such a situation. Furthermore, if the right-hand module as seen in FIG. 5 were positioned such that the lateral surface 32 thereof is disposed adjacent a side wall, the laterally extending support member 58 of the right-hand module could be eliminated even when associated with the roof of the furnace.

Figure 7:
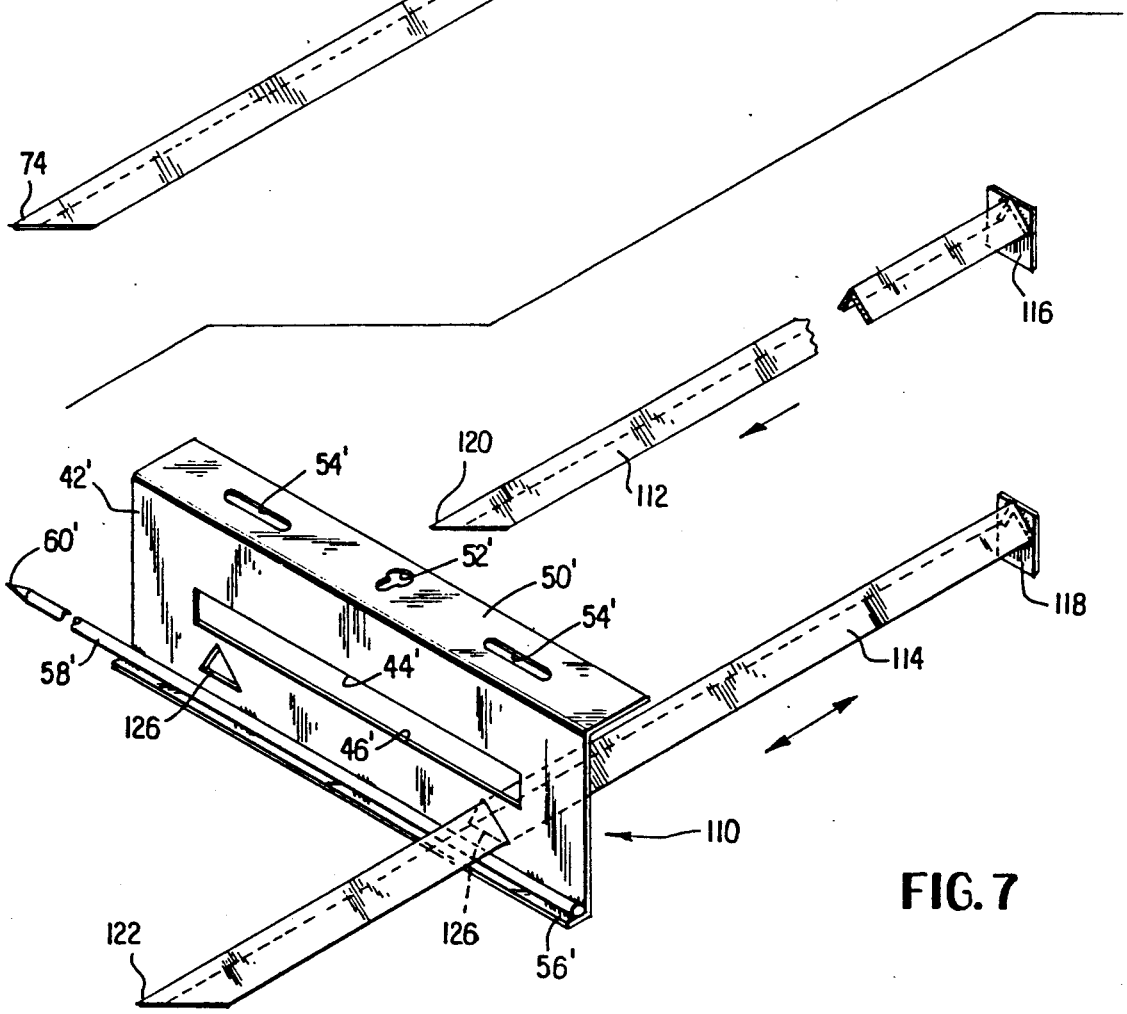
FIG. 7 is a top perspective partly exploded view of a second form of hanger means.

Referring now to FIG. 7, a modified hanger means 110 is shown which is similar to that shown in FIG. 6, similar parts being given the same reference numerals primed. In this form of the invention, the prongs 112 and 114 are formed separately. These prongs have substantially the same configuration as prongs 64 and 66 previously described, and are additionally provided with stop means 116 and 118 means to limit movement of the prongs with respect to the support portion of the hanger means. This stop means is shown as a separate plate attached as by welding to one end of each of the prongs. If desired, a portion of the angle member from which the prong is formed may be folded over to provided the stop means instead of utilizing a separate plate. The outer ends of the prongs are provided with pointed ends 120 and 122.

The plate portion 42' is provided with opening means in the form of triangular shaped openings which snugly slidably receive the prongs so that the prongs may be moved into operative position with the stop means disposed against plate portion 42'. This arrangement permits prongs of various lengths to be used with a particular support portion, and the hanger means may be assembled at any location, thereby simplifying shipping of the apparatus. A uniformly sized support portion may be used with many different length prongs, to provide additional versatility to apparatus. This feature is of particular advantage when using a hanger means with body means of insulation of different sizes as may occur in the field.

It should be understood that the first module in a given row may employ a hanger means as shown in FIG. 6. All subsequent hanger means may be of the type as shown in FIG. 7, since the prongs of each subsequent module will be held in place relative to its support portion by engagement with the side of the body means of a previously mounted module.

Figures 8, 9:
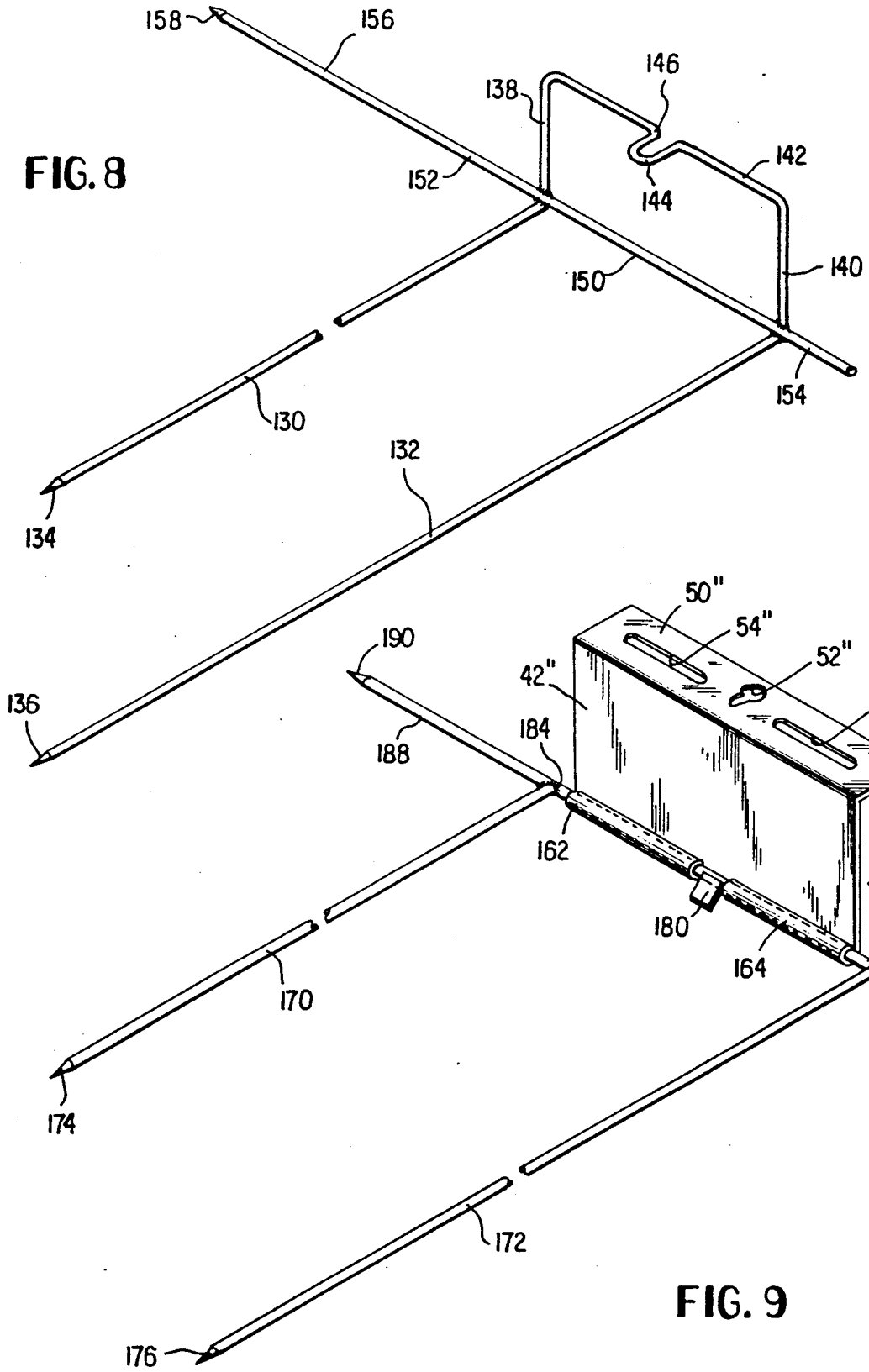
FIG. 8 is a top perspective view of a third form of hanger means.
FIG. 9 is a top perspective view of a fourth form of hanger means.

Referring now to FIG. 8, an integral stainless steel rod member includes generally parallel prongs 130 and 132 which terminate in pointed ends 134 and 136 respectively. Prongs 130 and 132 join with support portions 138 and 140 respectively which extend at substantially right angles to the prongs. A further portion 142 extends at substantially right angles between the portions 138 and 140 and includes a bight portion 144 at the middle thereof. The bight portion provides an opening 146 which is adapted to receive the reduced portion 86 of a stud 82 for connecting this hanger means to an interior surface.

A further rod member 150 of similar material is suitably connected to the aforementioned rod member as by welding. Rod member 150 includes laterally extending portions 152 and 154 just outwardly of the support portions 138 and 140 respectively. These laterally extending portions are adapted to engage the prongs of a similar hanger means of an adjacent module and thereby provide engaging surfaces for such prongs. The part 156 of rod member 150 forms a laterally extending support member which terminates in a pointed end 158 for piercing and supporting an expansion joint in the manner previously discussed. It is evident that the hanger means shown in FIG. 8 is of very simple construction, but it can be employed in the same manner as discussed in connection with the previous forms of hanger means in lining a furnace or the like.

Referring now to FIG. 9, a fourth form of hanger means 160 is shown wherein the upper portion of the support portion is similar to that shown in FIG. 6 and has been given the same reference numerals double primed. The lower edge of the stainless steel support plate 42'' is modified by turning up portions of the lower edge to form two spaced integral tubular portions 162 and 164 which rotatably support a cylindrical member 166 of similar material therein. A pair of generally parallel prongs 170 and 172 which may also be formed of stainless steel are suitably connected as by welding with member 166 and are provided with pointed ends 174 and 176 respectively.

Member 166 is has a laterally extending lug means 180 suitably connected thereto as by welding, this lug means fitting within the space between tubular portions 162 and 164 for limiting lateral movement of member 166 with respect to the support plate portion 42''. Member 166 is also provided with laterally extending portions 182 and 184 just outwardly of opposite side edges of plate portion 42'', such laterally extending portions being adapted to engage the prongs of a similar hanger means of an adjacent module and thereby provide engaging surfaces for such prongs. Member 166 also includes a portion 188 which defines a laterally extending support member terminating in a point 190 for penetrating and supporting an expansion joint in a manner previously described.

Figure 10:
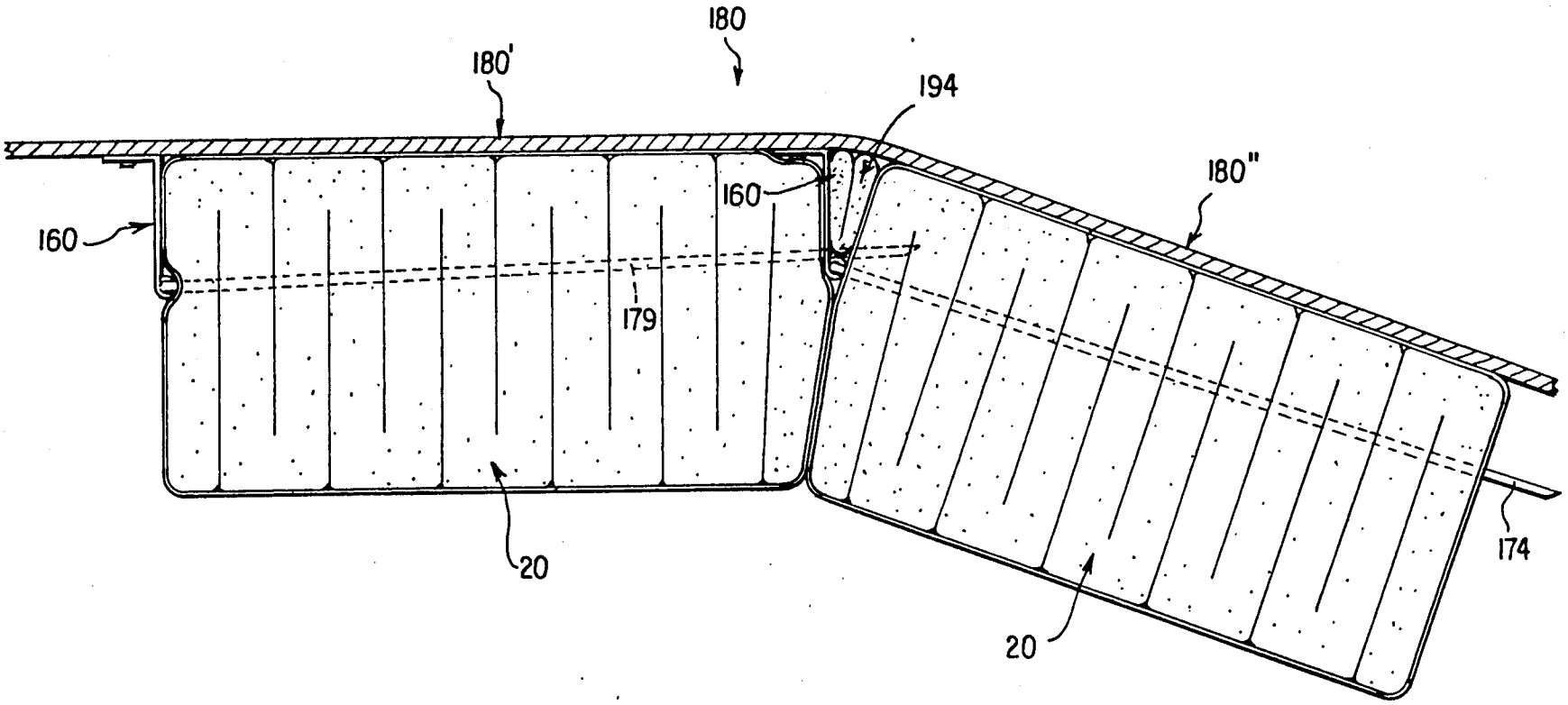
FIG. 10 is a sectional view through the roof of a furnace showing the manner in which the hanger means shown in FIG. 9 is employed with a furnace having roof portions disposed at an angle to one another.

It is apparent that in this form of the hanger means, the prongs are swingably supported by the support portion of the hanger means. This construction enables the invention to be utilized in a construction as shown in FIG. 10 wherein the roof 180 of a furnace or the like has portions 180' and 180'' which are disposed at an angle to one another. A pair of modules including the hanger means 160 as shown in FIG. 9 are shown. The prong means 174 of the right-hand module has been swung downwardly so as to support the associated body means at an angle to the body means of the left-hand module thereby defining spaced portions of the modules at the upper parts of facing sides of the two modules.

A filler joint 194 is inserted between the spaced portions of the two modules. This joint is formed by folding a strip of blanket insulation upon itself, and inserting the joint so that it is compressed somewhat. In this manner, an effective lining can be provided along interior wall portions which extend at an angle to one another.

Referring now to FIGS. 11 and 12, a further form of hanger means is illustrated. This hanger means is adapted to be used in chambers wherein the temperatures are very high. In these environments, it is necessary to provide a layer of insulation material which is thicker than those employed at lower temperatures. A significant problem when employing such thick blankets of insulation is that the fibers of the blanket which pass over the prongs of the hanger means tend to be severed by the prongs due to the additional weight of the thicker blanket which acts on the fibers.

In order to alleviate this problem, the prongs can be inserted at a lower level within the blanket of insulation to reduce the weight acting on the fibers. For example, the prongs may be spaced from the surface of the roof of a chamber a distance of three inches rather than the normal distance of one and one-half inches. In this manner the weight acting on the fibers extending over the prongs will be reduced. However, by lowering the prongs, the temperature that the prongs must resist is increased since there is less insulation between the prongs and the interior of the chamber. In order to resist this increased temperature, the prongs include portions of heat resistant ceramic material.

This form of hanger means includes cylindrical portions 200 and 202 formed of heat resistant ceramic material which may be about one inch in diameter. The outer ends 204 and 206 of the prongs are pointed to facilitate passage through blankets of insulation. Prongs 200 and 202 are provided adjacent the outer ends thereof with recesses 208 and 210 respectively in the form of annular grooves extending around the periphery of the ceramic portions. The inner ends of portions 200 and 202 have similar holes formed therein, the hole 212 within portion 202 being seen in FIG. 11.

The hanger means also includes an integral stainless steel rod member defining a pair of parallel prong support portions 220 and 222 which are received within the holes in the inner ends of the ceramic portions 200 and 202 so that the ceramic portions can be slipped on the prong support portions when lining a chamber.

Prong support portions 220 and 222 join with support portions 224 and 226 which extend at substantially right angles to the prong support portions. A further portion 228 extends at substantially right angles between portions 224 and 226 and includes a bight portion 230 at the middle thereof. The bight portion provides an opening 232 which is adapted to receive a portion of a mounting stud for connecting the hanger means to an interior surface.

A further rod member 240 of similar material is suitably connected to the connected to the aforementioned rod member as by welding. Rod member 240 includes laterally extending portions 242 and 244 just outwardly of the support portions 224 and 226 respectively. The part 246 of rod member 240 forms a laterally extending support member which terminates in a pointed end 248 for piercing and supporting an expansion joint in a manner similar to that previously discussed.

The ceramic portions 200 and 202 are much more rigid than the prongs in the modification as shown in FIG. 8, and accordingly, it may not be possible to support the prongs of one hanger means on the laterally extending portions such as portions 242 and 244 on an adjacent hanger means as described in connection with FIG. 8. Accordingly, it is anticipated that adjacent hanger means may be staggered with respect to one another so that the ceramic prong portions 200' and 202' of one hanger means will receive portions of rod member 240 of an adjacent hanger means as shown in FIG. 12.

As seen in FIG. 11, a modified module is illustrated employing this modified form of hanger means. This module includes a pleated blanket of insulation material surrounded by a retaining means similar to the construction shown in FIG. 1. Corresponding parts in FIG. 11 are provided with the same reference numerals primed as those shown in FIG. 1. The blanket shown in FIG. 11 is of greater thickness than that shown in FIG. 1. As seen in FIG. 11 the prongs of the hanger means extend completely through the insulation and the outer ends of the prongs project beyond the side of the insulation. This module is employed in substantially the same manner as the module shown in FIG. 2 in lining a chamber.

It should be understood that the invention has been described in connection with the roof of a furnace or the like. However, the very same method steps can be employed with respect to the sides or floor of such a high temperature chamber.

The invention has been described with reference to a preferred embodiment. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. The method of lining the interior surface of a high temperature chamber with heat insulation material, comprising providing a plurality of blankets of heat insulation material each of which is folded upon itself to form a body means of pleated configuration having opposite sides and being surrounded by a retaining means to retain the body in its pleated configuration, providing a plurality of hanger means each of which includes a support portion having elongated prong means extending therefrom, inserting the prong means of each of said hanger means through one of said body means to form a plurality of modules each of which has the support portion of the associated hanger means disposed adjacent one of said opposite sides of the associated body means with the outer end portion of the prong means extending outwardly beyond the other of said opposite sides of the associated body means, supporting a plurality of said modules from said interior surface by supporting the hanger means of the modules on said surface with pairs of adjacent modules having certain ones of said opposite sides in abutting relationship and the outer end portion of the prong means of one of a pair of adjacent modules directly engaging the support portion of the other one of said pair of modules to stabilize the adjacent modules and ensure that they are accurately located and maintained in operative position to thereby line said interior surface.

2. The method as defined in claim 1 wherein the hanger means of one of said modules is supported from said interior surface by connecting the support portion thereof to said interior surface with the associated body means disposed adjacent said inner surface, then moving the hanger means of another of said modules against the other of said opposite sides of said one module to compress the body means of said one module, connecting the support portion of said other module to said inner surface with the associated body means disposed adjacent said inner surface, and engaging the outer end portion of the prong means of said one module on an engaging surface of said other module.

3. The method as defined in claim 2 wherein the step of engaging the outer end portion of the prong means of said one module on an engaging surface of said other module includes the step of inserting the outer end portion of said prong means of said one module into opening means formed in said other module.

4. The method as defined in claim 1 wherein the prong means of one of said pair of adjacent modules is engaged with the support portion of the other of said pair of modules by providing opening means in said support portions and by inserting the outer end portion of the prong means of said one module through the opening means of said other module.

5. The method as defined in claim 1 wherein the prong means of one of said pair of modules is engaged with the support portion of the other of said pair of modules by providing laterally extending means on said hanger means and by engaging the outer end portion of the prong means of said one module with the laterally extending means on said other module.

6. The method as defined in claim 5 including the steps of providing recess means in the outer end portion of the prong means, and placing said laterally extending means within said recess means.

7. The method as defined in claim 1 including the steps of folding a length of heat insulation blanket to form an expansion joint, each of said modules having a pair of lateral sides joining said opposite sides, inserting said joint between lateral sides of laterally facing modules to provide a joint therebetween, and supporting said joint from the hanger means of one of said laterally facing modules.

8. The method as defined in claim 1 wherein said prong means are swingable relative to the associated support portions, and including the step of swinging the prong means of the other of said pair of modules relative to the associated support portion to support the associated body means at an angle to the body means of said one of said pair of modules to line an interior surface having portions disposed at an angle to one another.

9. The method as defined in claim 8 including the step of inserting a filler joint of insulation material between spaced portions of facing ones of the opposite sides of said pair of adjacent modules.

* * * * *